US005754204A

United States Patent [19]

Kitahara

[11] Patent Number: 5,754,204

[45] Date of Patent: May 19, 1998

[54] INK JET RECORDING HEAD

[75] Inventor: Tsuyoshi Kitahara, Nagano, Japan

[73] Assignee: Seiko Epson Corporation, Tokyo, Japan

[21] Appl. No.: 606,264

[22] Filed: Feb. 23, 1996

[30] Foreign Application Priority Data

Feb. 23, 1995 [JP] Japan ..... 7-059893
Feb. 7, 1996 [JP] Japan ..... 8-045402

[51] Int. Cl.[6] ..... B41J 2/045

[52] U.S. Cl. ..... 347/70

[58] Field of Search ..... 347/20, 37, 54, 347/68, 70, 74, 75, 78

[56] References Cited

U.S. PATENT DOCUMENTS

| | | | |
|---|---|---|---|
| 4,571,599 | 2/1986 | Rezanka | 347/87 |
| 4,697,193 | 9/1987 | Howkins | 347/70 |
| 5,177,504 | 1/1993 | Ishii et al. | 347/68 |
| 5,510,816 | 4/1996 | Hosono et al. | 347/70 |
| 5,646,662 | 7/1997 | Kitahara | 347/70 |

*Primary Examiner*—Matthew V. Nguyen
*Attorney, Agent, or Firm*—Sughrue, Mion, Zinn, Macpeak & Seas, PLLC

[57] ABSTRACT

An ink jet recording head is used which has: a pressure chamber which is communicated with a nozzle opening of a nozzle plate and with a reservoir through an ink supply port; and a piezoelectric vibrator for, in response to a driving signal, producing volume displacement in the pressure chamber, the inertance Mn of the nozzle opening and the inertance Ms of the ink supply port having the relationship of 0.5<Mn/(Mn+Ms) is used. The meniscus is rapidly returned to the nozzle opening by an inertial energy which is due to the ink suction to the pressure chamber, so that the ink ejection is conducted in the vicinity of the nozzle opening, thereby enabling an ink drop which is substantially spherical to be ejected. The contraction time period of the piezoelectric vibrator for sucking ink into the pressure chamber, and an expansion time period of the piezoelectric vibrator for ejecting an ink drop from the nozzle opening are set to be 1/f (where f is the Helmholtz's resonance frequency) so that the residual vibration of the meniscus is reduced to a level as low as possible, thereby allowing the record head to be driven at a high speed.

9 Claims, 8 Drawing Sheets

INK JET RECORDING HEAD

BACKGROUND OF THE INVENTION

1. Field of the invention

The invention relates to an ink jet recording head in which a pressure chamber is caused to contract by a piezoelectric vibrator operating in accordance with a print signal, thereby ejecting an ink drop from a nozzle opening.

2. Related art

An ink jet recording head can conduct printing at a speed higher than a wire dot record head or a thermal transfer record head, and at a density of a similar level as that of a thermal transfer record head. Consequently, a recording apparatus using an ink jet recording head becomes widespread with gradually expelling printers using a wire dot record head or a thermal transfer record head and begins to stand comparison with a page printer using the electrostatic printing system.

Ink jet recording heads are classified into two types, a type in which heating means is disposed in a pressure chamber, ink is instantaneously evaporated by thermal energy, and a pressure generated as a result of the evaporation causes an ink drop to be ejected, and another type in which a part of a pressure chamber is configured so as to be elastically deformable and the pressure chamber is compressed by a piezoelectric vibrator, thereby ejecting an ink drop. In the latter type, the pressure chamber can be pressed while attaining relative relationships with the extension rate of the piezoelectric vibrator and the meniscus. Therefore, a record head of the type has a feature that it can conduct printing of a high quality.

On the other hand, in order to stably obtain a high printing quality, it is required to delicately control the position of the meniscus and the timing of compressing the pressure chamber by the piezoelectric vibrator. To comply with this, various control systems have been proposed.

For example, U.S. Pat. No. 4,697,193 discloses a record head in which a pressure chamber is formed so that the Helmholtz's resonance frequency is not lower than 10 kHz and not higher than 100 kHz, and a piezoelectric vibrator is caused to contract so that the pressure chamber expands, thereby sucking ink into the pressure chamber. At the timing when the meniscus of a nozzle opening is retracted by expansion of the pressure chamber to a predetermined position on the side of the pressure chamber, the piezoelectric vibrator is caused to expand so that the pressure chamber contracts, thereby ejecting an ink drop.

In such a record head, since the meniscus in the ink ejection process is constant, the volume and flying speed of an ink drop are constant irrespective of the period of forming an ink drop, i.e., the cycle of the ink drop formation, thereby producing an effect that printed dots are stabilized in density and position.

In the record head, however, an ink drop is ejected by compressing the pressure chamber in a state wherein the meniscus is somewhat pulled from the surface of a nozzle opening toward the pressure chamber, and hence the ink drop tends to have a column-like shape.

In the case where the feed speed of the record head is low, the shape of an ejected ink drop is not particularly significant. By contrast, in the case where the record head is rapidly moved in order to conduct high-speed printing, the time when the rear portion of an ink drop reaches a record sheet is made different from that when the front portion of the same ink drop reaches the sheet. This temporal difference causes the ink dot to be printed in a form which elongates in the moving direction of the record head or in an elliptical shape, thereby producing a problem in that the printing quality is impaired.

SUMMARY OF THE INVENTION

The invention has been conducted in view of the problem. It is an object of the invention to provide a novel ink jet recording head which can eject an ink drop of a shape that is as spherical as possible, without lowering the driving frequency.

In order to solve the problem, according to the invention, an ink jet recording head comprises: a pressure chamber which is communicated with a nozzle opening of a nozzle plate and with a reservoir through an ink supply port; and displacement producing means for, in response to a driving signal, producing volume displacement in the pressure chamber, and the inertance Mn of the nozzle opening and the inertance Ms of the ink supply port are set so as to be $0.5<Mn/(Mn+Ms)$.

The meniscus is rapidly returned to the nozzle opening by an inertial energy which is due to the ink suction to the pressure chamber, so that the ink ejection is conducted in the vicinity of the nozzle opening, whereby an ink drop which is substantially spherical is enabled to be ejected. The contraction time period of a piezoelectric vibrator for sucking ink into the pressure chamber, and an expansion time period of the piezoelectric vibrator for ejecting an ink drop from the nozzle opening are set to be 1/f. As a result, the residual vibration of the meniscus is reduced so that the record head can be driven at a high frequency.

DETAILED DESCRIPTION OF THE PREFERRED EMBODIMENTS

Hereinafter, the invention will be described in detail on the basis of illustrated embodiments.

Figure 1:
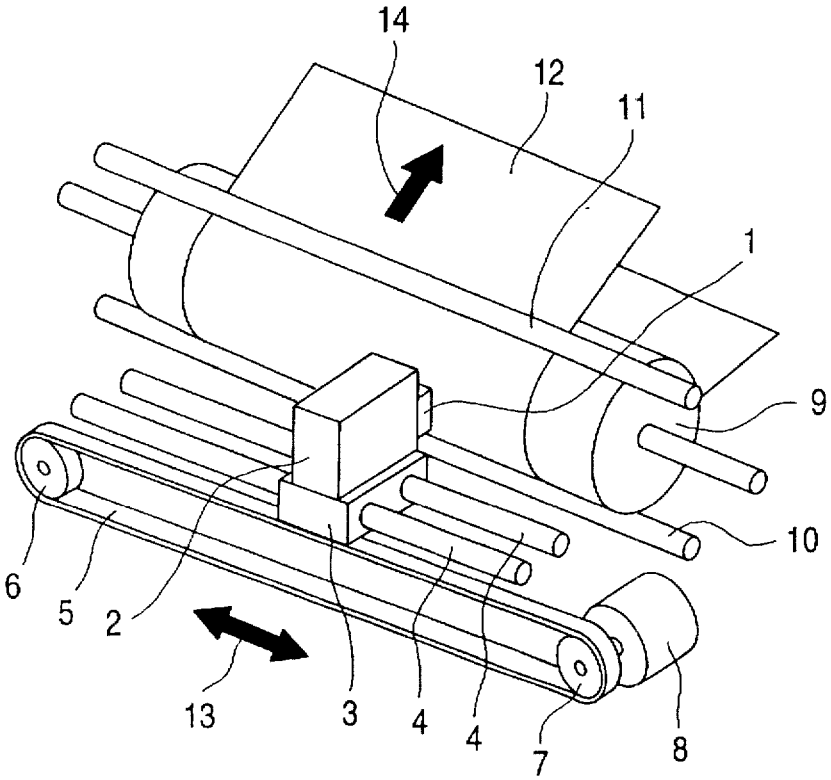
FIG. 1 is a view showing an embodiment of an ink jet printer to which the driving system of the ink jet recording head of the invention is applied.
Figure 2:
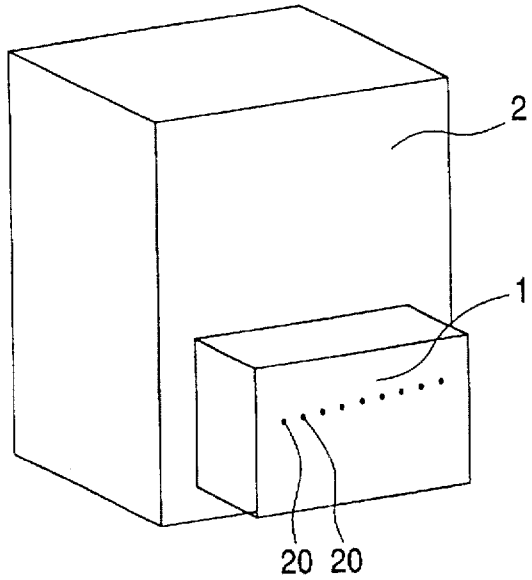
FIG. 2 is a view showing the arrangement of nozzle openings of an ink jet recording head which is used in the driving system of the invention.

FIG. 1 shows an embodiment of an ink jet recording apparatus which uses the record head of the invention. In the figure, 1 designates the ink jet recording head of the invention which will be described later. In the embodiment, the ink jet recording head is mounted together with an ink tank 2 on a carriage 3 which is supported by guiding members 4 so as to be movable in the axial direction of a platen 9. As shown in FIG. 2, nozzle openings are formed at predetermined intervals in the sheet feed direction. The carriage 3 is connected to a timing belt 5 one end of which is wound around an idle roller 6 and the other end of which is wound around a driving roller 7 fixed to the shaft of a pulse motor 8, so as to be movable in the directions of arrows indicated by 13 in the figure.

The platen 9 to which a record sheet 12 is set by sheet press rollers 10 and 12 is connected to a driving source (not shown) so as to feed the record sheet in the direction of an arrow indicated by 14 in FIG. 1.

Figure 3:
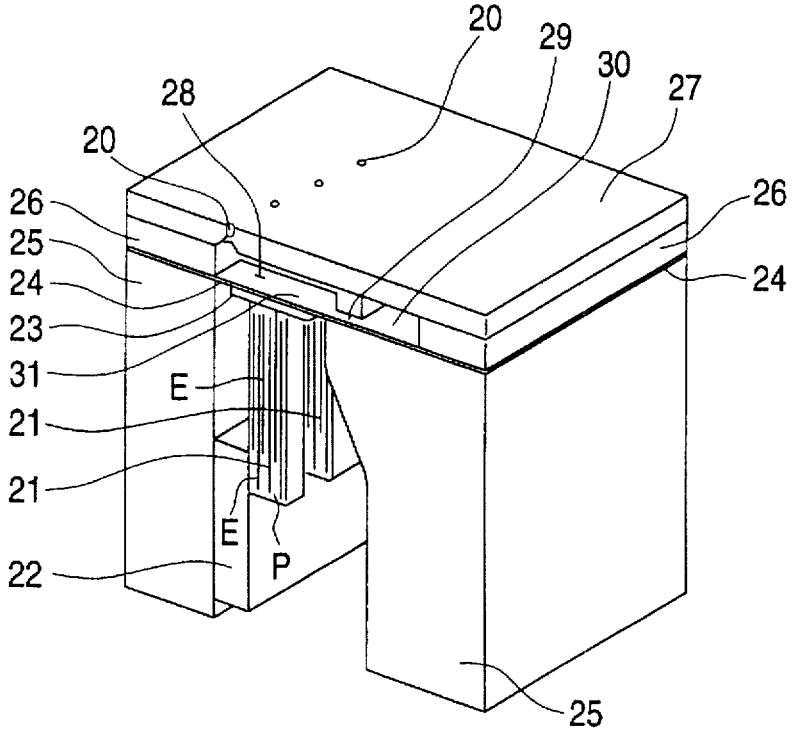
FIG. 3 is a perspective view partly in section showing an embodiment of an ink jet recording head which is used in the driving system of the invention.

FIG. 3 shows an embodiment of the ink jet recording head described above. In the figure, 28 designates pressure chambers. Each pressure chamber is formed by sealing one end of a through hole opened in a channel plate 26 by a nozzle plate 27, and the other end by an elastic plate 24 which is subjected to elastic deformation by piezoelectric vibrators 21 described later.

The pressure chamber 28 is communicated at one end with a nozzle opening 20 and at the other end with a reservoir 30 through an ink supply port 29.

In FIG. 3, 21 designates the piezoelectric vibrators which are fixed at one end to a pedestal 22 at the same pitch as that of the nozzle openings 20, and abut at the other end against the elastic plate 24 forming the pressure chamber 28, through abutting members 23. The abutting members 23 are longer than the piezoelectric vibrators 21 so as to perform a function of pressing a wide area of the pressure chamber 28 so that the driving energy exerted by the piezoelectric vibrators 21 is efficiently used for ejecting ink.

Each of the piezoelectric vibrators 21 is configured by alternatingly stacking a piezoelectric material P and an electrically conductive layer E, and has a longitudinal vibration mode in which the vibrator expands or contracts in the axial direction, or more specifically, when a driving signal is applied across the electrically conductive layers, the vibrator expands in the axial direction and, when the driving signal is extinguished, the vibrator contracts. The piezoelectric vibrators 21 can be driven at a higher speed than a piezoelectric vibrator of the flexural vibration mode, and set to have the natural frequency of 50 to 400 kHz.

In the invention, using the above, each piezoelectric vibrator 21 is configured so as to have the natural frequency which is substantially equal to the Helmholtz's resonance frequency f of the pressure chamber 28.

In FIG. 3, 25 designates a frame to which the flexible plate 24, the channel plate 26, the nozzle plate 27, and the pedestal 22 are fixed.

When the compliance of the pressure chamber 28 due to the compressibility of ink is indicated by Ci, the rigid compliance due to the materials of the elastic plate 24, the nozzle plate 27, and the cannel plate 26 which constitute the pressure chamber 28 is indicated by Cv, the inertance of each nozzle opening 20 by Mn, and the inertance of the ink supply port 29 by Ms, the Helmholtz's resonance frequency f of the pressure chamber 28 can be expressed by $$f=1/2\pi\times\sqrt{\{(Mn+Ms)/(Ci+Cv)(Mn\times Ms)\}}$$

When the volume of the pressure chamber 28 is indicted by V, the density of ink by ρ, and the sound velocity in the ink by c, the compliance Ci can be expressed by $$ci=V/\rho c^2$$

The rigid compliance Cv of the pressure chamber 28 coincides with the static deform rate of the pressure chamber 28 obtained when a unit pressure is applied to the pressure chamber 28.

In the invention, the suction of ink from the reservoir and the ejection of ink from the nozzle opening are conducted by using the piezoelectric vibrator 21 of the longitudinal vibration mode. When the pressure chamber of the ink jet recording head has a length of 0.5 to 2 mm, a width of 0.1 to 0.2 mm, and a depth of 0.05 to 0.3 mm, therefore, the Helmholtz's resonance frequency of the chamber is 50 to 200 kHz.

In other words, when the volume of the pressure chamber is to be changed by the piezoelectric vibrator of the longitudinal vibration mode, it is sufficient for the piezoelectric vibrator to abut at its tip end against the elastic plate constituting the pressure chamber, resulting in that the abutting area is very small. Since the pressure chamber itself is very larger in rigidity than the piezoelectric vibrator of the flexural vibration mode, it is possible to generate a high pressure. As a synergistic effect of these phenomena, ink of a sufficient amount can be ejected even when the pressure chamber is configured so as to be very small.

Since the Helmholtz's resonance frequency f is very high as described above, the values ωMn and ωMs respectively obtained by multiplying the inertia (impedance) or the inertances of the nozzle opening 20 and the ink supply port 29 by the angular frequency ω=2πf of the Helmholtz's resonance frequency f are greater than the viscosity resistances Rn and Rs of the nozzle opening 20 and the ink supply port 29. As a result, the energy is conserved.

Even when the expansion of the pressure chamber is stopped, therefore, the ink flow in the pressure chamber is conserved by the inertia, with the result that the meniscus performs the movement more actively.

Figure 4:
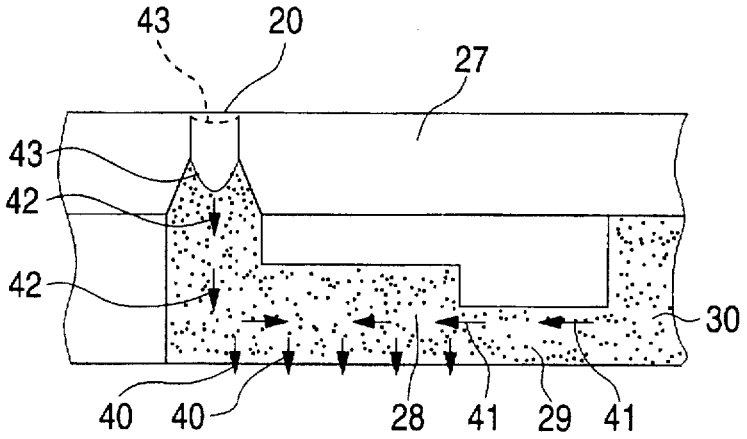
FIGS. 4(*a*) to 4(*c*) are diagrams showing the operation of the ink jet recording head.
Figure 4:
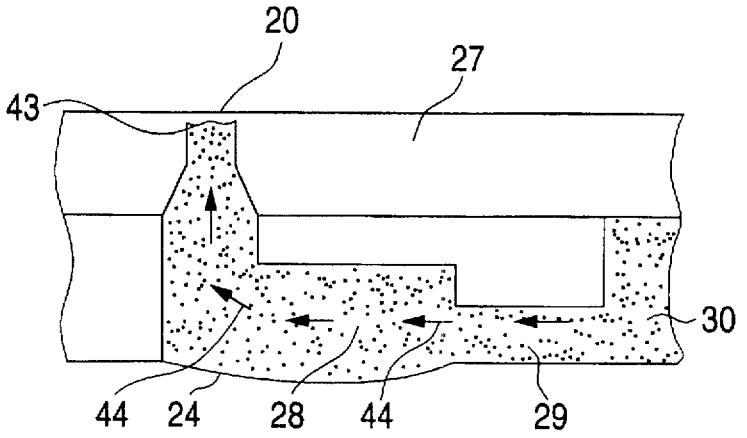
Figure 4:
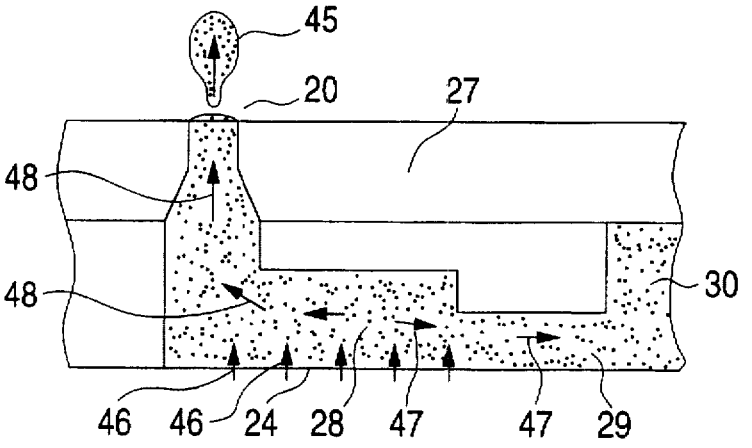

Specifically, when the piezoelectric vibrator contracts so as to apply to the elastic plate 24 a force 40 which causes the pressure chamber 28 to expand as shown in FIG. 4, a negative pressure is generated in the pressure chamber 28 so that an ink flow 41 is produced from the reservoir 30 to the pressure chamber 28 through the ink supply port 29, and at the same time a flow 42 is produced so as to pull the meniscus 43 of the nozzle opening 20 toward the pressure chamber as shown FIG. 4(*a*).

If as described above the Helmholtz's resonance frequency f of the pressure chamber 28 is selected to be 50 kHz or higher and the inertance of the nozzle opening 20 is particularly selected to have a large value, an inertia flow 44 of ink from the reservoir 30 to the pressure chamber 28 becomes large. As a result, the meniscus 43 which has been pulled toward the pressure chamber is pushed back so as to be rapidly returned to the original position, i.e., the position where it is located before the pressure chamber 28 expands as shown in FIG. 4(*b*).

At the timing when the meniscus 43 is returned to the original position, a force 46 is applied to the elastic plate 24 so that the pressure chamber 28 contracts, an ejected ink drop 45 has a shape which is as spherical as possible. Also at this timing, there exists the above-described inertia flow 44 directed to the nozzle opening 20. Therefore, the contraction of the pressure chamber 28 causes an ink flow 48 to be superposed on the inertia flow so that the ink drop to which the energy of the inertia flow 44 is added is ejected, resulting in that the ink drop is ejected at a high speed as shown in FIG. 4(*c*). The reference numeral 47 designates an ink flow which returns to the reservoir.

Consequently, the time period from the start of the ink suction to the ejection timing when the ejected ink drop has a shape which is as spherical as possible, i.e., the position of the meniscus in the rest period is very short. Accordingly, it is possible to shorten the period of one printing cycle consisting of the ink suction and the ink ejection.

Figure 5:
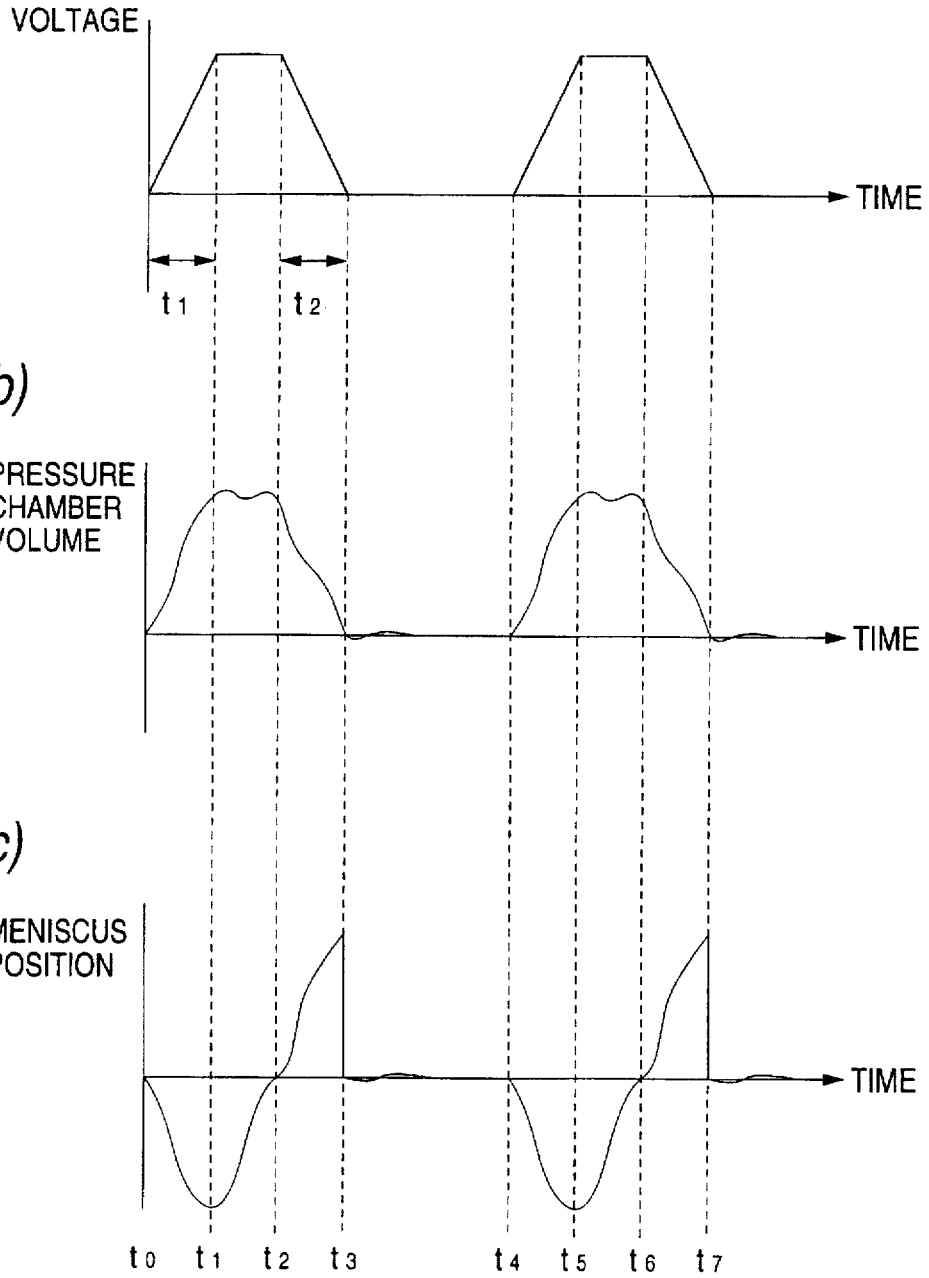
FIGS. 5(*a*) to 5(*c*) are views respectively showing a driving signal to be applied to the ink jet recording head, the change in volume of a pressure chamber, and the position of the meniscus.

On the other hand, as described above, the piezoelectric vibrator 21 is configured so as to have the natural frequency which is substantially equal to the Helmholtz's resonance frequency f. In the expansion step of the pressure chamber or the contraction step of the piezoelectric vibrator, and the contraction step of the pressure chamber or the expansion step of the piezoelectric vibrator, a voltage which rises at a uniform rate and that which lowers at a uniform rate are applied so as to coincide with the Helmholtz's resonance frequency f or for the period $1/f=\tau 1$ and $1/f=\tau 2$ (FIG. 5(*a*)), whereby the residual vibration of the elastic plate 24 constituting the pressure chamber 28 and that of the piezoelectric vibrator 21 can be suppressed to a level which is as low as possible (FIG. 5(*b*)). After an ink drop is ejected, therefore, also the meniscus is rapidly stabilized (FIG. 5(*c*)).

Accordingly, when the Helmholtz's resonance frequency of the pressure chamber 28 is set to be 100 kHz and the period of natural vibration of the piezoelectric vibrator 21 to be 100 kHz, for example, the period of ink drop ejection, i.e., the driving frequency of the ink jet recording head can be set to be 35 kHz at the maximum.

When the Helmholtz's resonance frequency f of the pressure chamber 28 is set to be a large value as described above, the time period required for returning the meniscus to the nozzle opening 20 after the expansion of the pressure chamber can be shortened by using the effect of the inertia flow so that spherical ink drops are ejected at a high cycle. The inventors have found that, when the inertance Mn of the nozzle opening 20 and the inertance Ms of the ink supply port 29 are optimized, the printing quality can be further improved.

Figure 6:
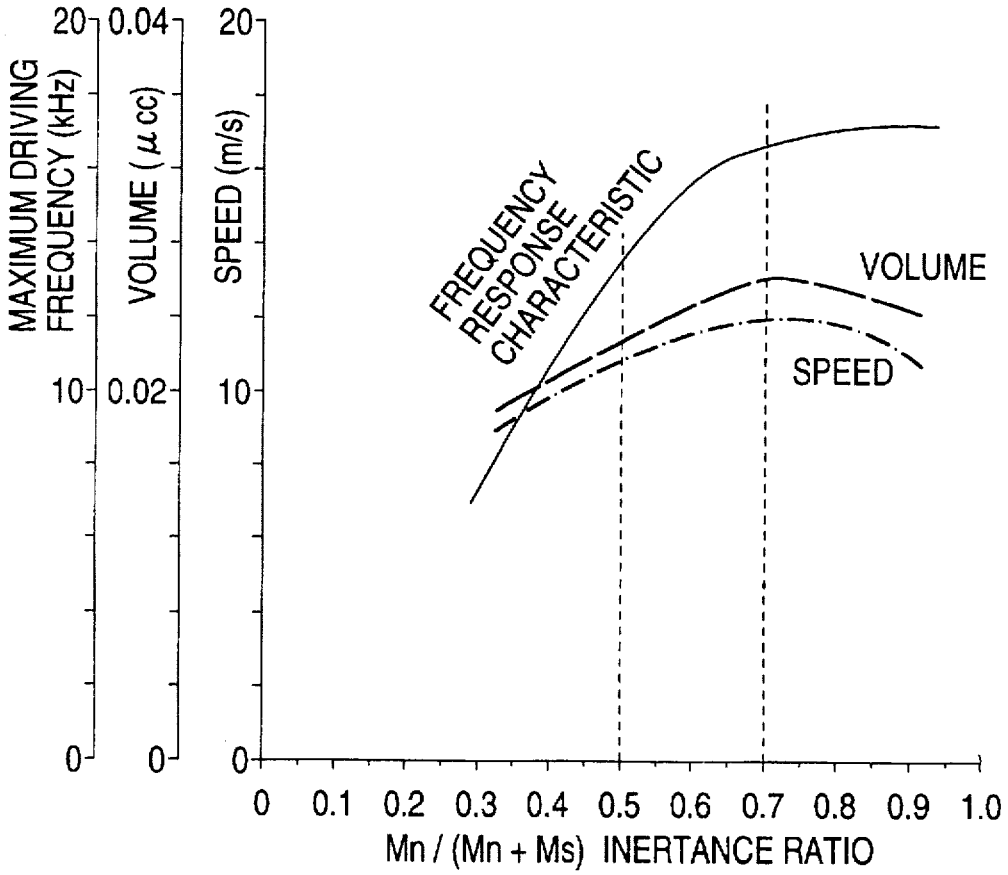
FIG. 6 is a graph showing a driving frequency, the volume of an ink drop, and the speed of the ink drop with respect to the inertance ratio.

As shown in FIG. 6, the more the ratio of the inertance Mn of the nozzle opening to the sum (Mn+Ms) of the inertance Mn of the nozzle opening and the inertance Ms of the ink supply port:

$$Mn/(Mn+Ms),$$

i.e., the ratio of the inertia flow on the side of the nozzle opening proceeds from 0.3, the more the speed and volume of an ink drop are increased in proportion to the inertance ratio. The speed and volume are maximum when the ratio is at about 0.7. When the inertance ratio is further increased, they are gradually decreased.

When the inertance ratio Mn/(Mn+Ms) is small, the returning time period is constant as far as the meniscus due to the expansion of the pressure chamber 28 moves only in the vicinity of the nozzle plate 27, and hence the driving frequency is not largely lowered. By contrast, when the inertance ratio is 0.5 or less, the meniscus moves from the nozzle plate 27 to enter the pressure chamber 28 so that the time period required for returning is largely prolonged, with the result that the driving frequency is largely lowered.

The invention positively uses this phenomenon. In order to maintain the speed and volume of an ink drop to a level which is sufficiently high in the practical view point without lowering the driving frequency, the inertance ratio Mn/(Mn+Ms) is selected to be 0.5 or larger and more preferably about 0.5 or larger and 0.7 or less, and as described above the Helmholtz's resonance frequency is set to be 50 kHz or higher, with succeeding in forming an ink drop ejected by ink ejection which is caused in the vicinity of a nozzle opening by the effect of the inertia flow, into a spherical shape.

In the embodiment described above, the example in which a piezoelectric vibrator uses expansion and contraction in the direction perpendicular to the arrangement direction of the electrically conductive layers E formed between the piezoelectric materials P has been described. Apparently, also the configuration shown in FIG. 7 in which a piezoelectric vibrator 51 expands and contracts in the directions parallel to the stacking direction of the electrically conductive layers E can attain the same effect.

Figure 7:
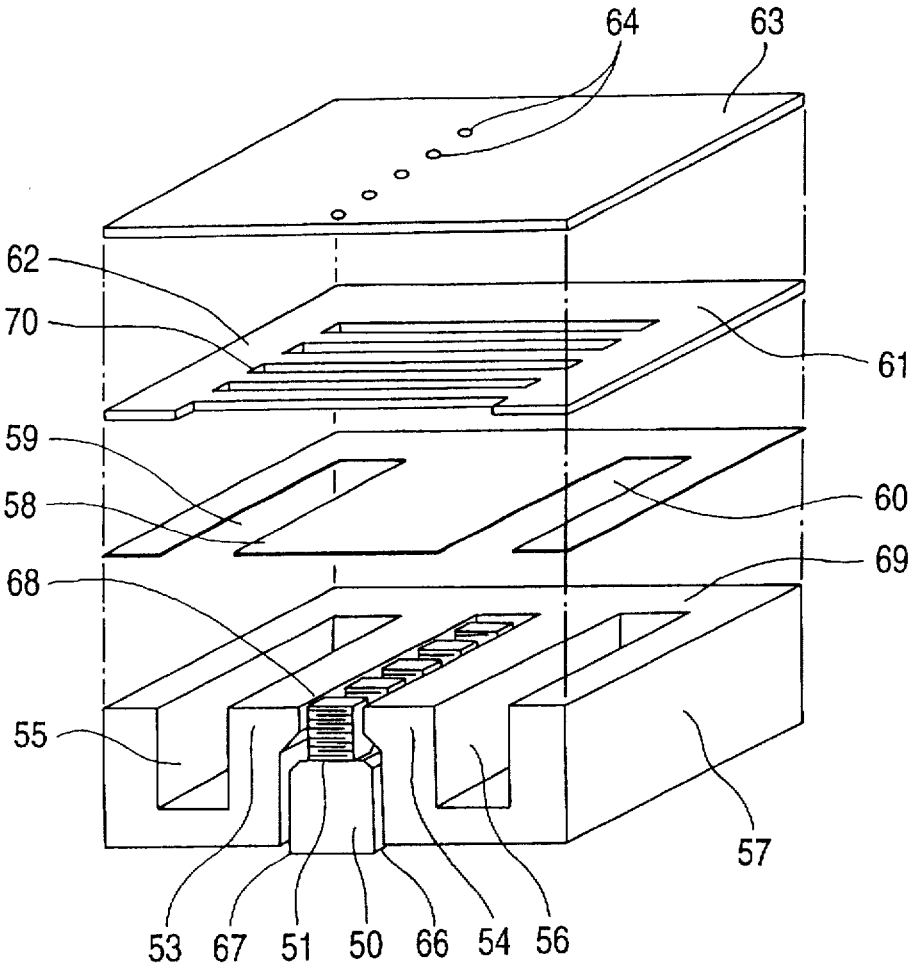
FIG. 7 is a perspective view partly in section showing an embodiment of another ink jet recording head to which the invention can be applied.
Figure 8:
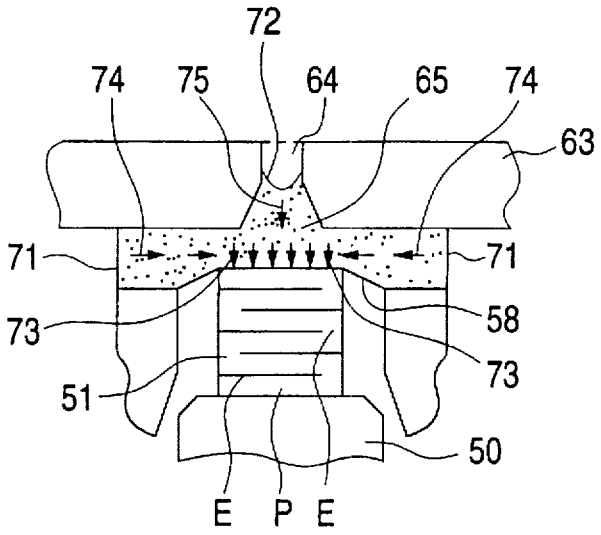
FIGS. 8(*a*), 8(*b*), and 8(*c*) are diagrams showing the operation of the ink jet recording head.
Figure 8:
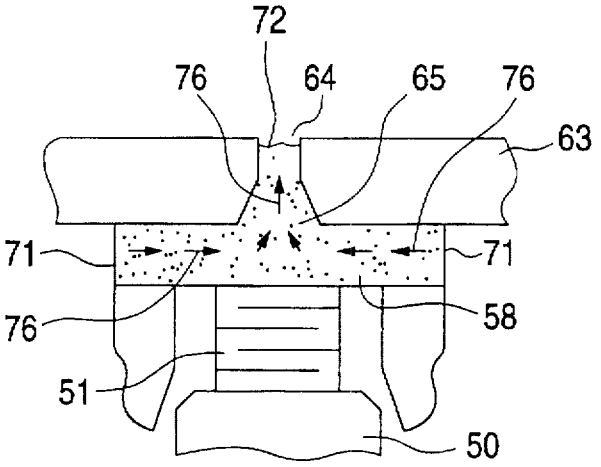
Figure 8:
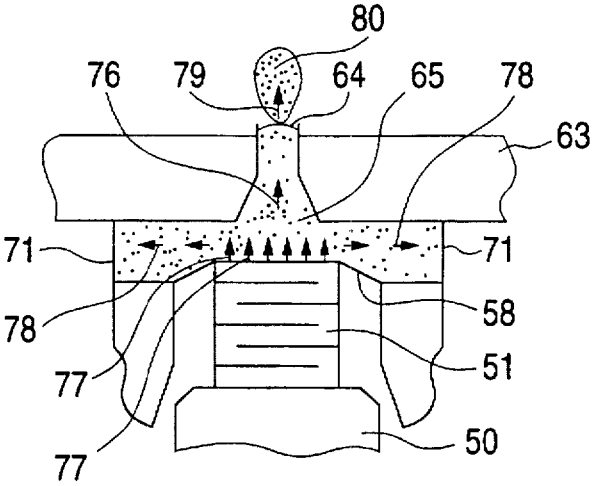

FIG. 7 shows another embodiment of an ink jet recording head to which the invention can be applied. In the figure, 51 designates piezoelectric vibrators having the longitudinal vibration mode. Each of the piezoelectric vibrators 51 has a structure in which a piezoelectric material P and an electrically conductive layer E are alternatingly stacked, and expands and contracts in the stacking direction. One end of the vibrator is fixed to a pedestal 50 and the other end abuts against an elastic plate 58.

The reference numeral 57 designates a frame in which reservoirs 55 and 56 elongating in the arrangement direction of the piezoelectric vibrators 51 are respectively formed at both sides so as to sandwich the piezoelectric vibrators 51. The elastic plate 58 is placed on the upper face of the frame. Windows 59 and 60 for supplying ink to pressure chambers 70 which will be described later are formed.

The reference numeral 61 designates a channel plate in which slots serving as the pressure chambers 70 are opened so as to reach the reservoirs 55 and 56 at both sides and conform to the arrangement of the piezoelectric vibrators 51, thereby forming channels for supplying ink to pressure chambers 65 through ink supply ports 71. The reference numeral 63 designates a nozzle plate which seals the other faces of the channel plate 61 and in which nozzle openings 64 are opened at positions opposing the piezoelectric vibrators 51.

In the same manner as described above, the Helmholtz's resonance frequency f of the pressure chambers 70 is selected to be about 50 to 200 kHz, and the natural frequency of the piezoelectric vibrators 51 to be equal to the Helmholtz's resonance frequency f of the pressure chambers 70.

According to this configuration, when the piezoelectric vibrator 51 contracts so as to cause the elastic plate 58 to generate a force 73 in the direction along which the pressure chamber 65 expands, a negative pressure is generated in the pressure chamber 65 so that ink flows 74 are produced from the reservoirs 55 and 56 to the pressure chamber 65 through the ink supply ports 71 at both sides, and at the same time a flow 75 is produced so as to pull the meniscus 72 of the nozzle opening 64 toward the pressure chamber (FIG. 7(*a*)).

If as described above the Helmholtz's resonance frequency f of the pressure chamber 65 is selected to be 50 kHz or higher and the inertance of the ink supply ports 71 is particularly selected to have a large value, inertia flows 74 of ink from the reservoirs 55 and 56 to the pressure chamber 65 become large. As a result, the meniscus 72 which has been pulled toward the pressure chamber is pushed back so as to be rapidly returned to the original position, i.e., the position where the meniscus is located before the pressure chamber 65 expands (FIG. 7(*b*)).

At the timing when the meniscus 72 is returned to the original position, a force 77 is applied to the elastic plate 58 so that the pressure chamber 65 contracts and an ejected ink drop 80 then has a shape which is as spherical as possible. Also at this timing, there exists the above-described inertia flow 76 toward the nozzle opening 64. Therefore, the contraction of the pressure chamber 65 causes an ink flow to be superposed on the inertia flow so that the ink drop to which the energy of the inertia flow 76 is added is ejected, resulting in that the ink drop is ejected at a high speed (FIG. 7(*c*)). The reference numeral 78 designates ink flows which return to the reservoirs 55 and 56 at both sides.

Consequently, the time period from the start of the ink suction to the ejection timing when the ejected ink drop has a shape which is as spherical as possible, i.e., the position of the meniscus in the rest period is very short. As a result, it is possible to shorten the period of one printing cycle consisting of the ink suction and the ink ejection.

Figure 9:
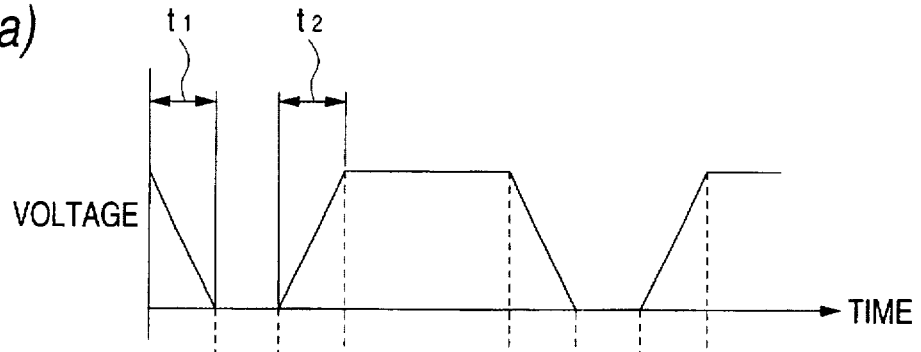
FIGS. 9(*a*) to 9(*c*) are view respectively showing a driving signal to be applied to the ink jet recording head, the change in volume of a pressure chamber, and the position of the meniscus.
Figure 9:
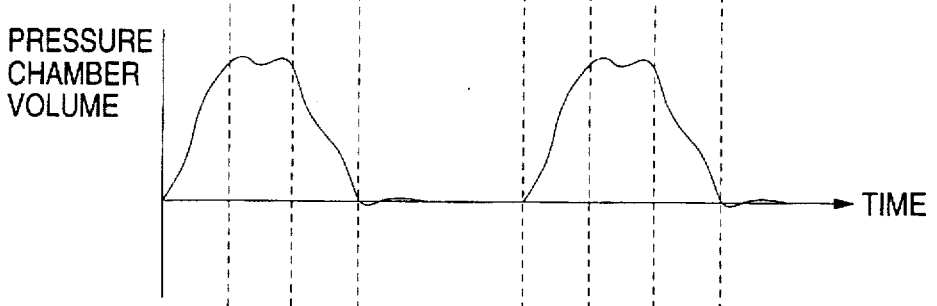
Figure 9:
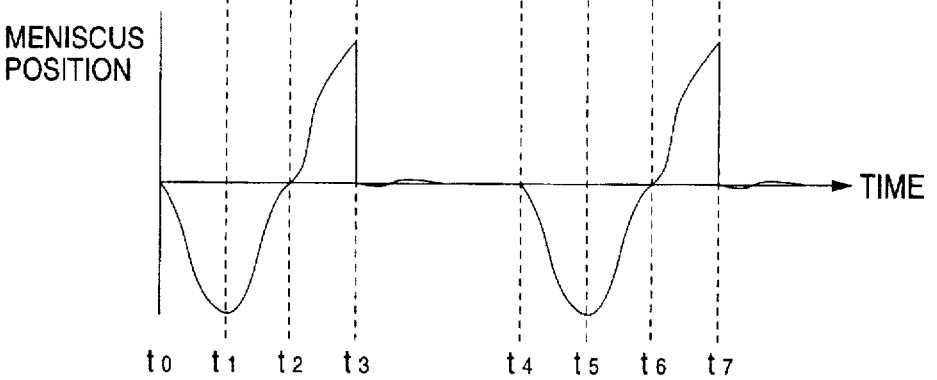

On the other hand, as described above, the piezoelectric vibrator 51 is configured so as to have the natural frequency which is substantially equal to the Helmholtz's resonance frequency f. In the expansion step of the pressure chamber or the contraction step of the piezoelectric vibrator 51, and the contraction step of the pressure chamber or the expansion step of the piezoelectric vibrator, a voltage which lowers at a uniform rate and that which rises at a uniform rate are applied so as to coincide with the Helmholtz's resonance frequency f or for the period $1/f=\tau 1$ and $1/f=\tau 2$ (FIG. 9(*a*)), whereby the residual vibration of the elastic plate 58 constituting the pressure chamber 65 and that of the piezoelectric vibrator 51 can be suppressed to a level which is as low as possible (FIG. 9(*b*)). After an ink drop is ejected, therefore, also the meniscus is rapidly stabilized (FIG. 9(*c*)).

When the ratio of the inertance Mn of the nozzle opening 64 to the sum (Mn+Ms') of the inertance Mn of the nozzle opening and the total inertance Ms' of the two ink supply ports 71, Mn/(Mn+Ms'), i.e., the ratio of the inertia flow on the side of the nozzle opening is gradually increased with starting from 0.3, the speed and volume of an ink drop are proportionally increased. The speed and volume are maximum when the ratio is at about 0.7. When the inertance ratio is further increased, they are gradually decreased.

When the inertance ratio is large, the returning time period is constant as far as the meniscus 72 due to the expansion of the pressure chamber 65 moves only in the vicinity of the nozzle plate 63, and hence the driving frequency is not largely lowered. By contrast, when the inertance ratio exceeds 0.7, the time period required for stabilizing the meniscus is prolonged by the amount corresponding to the reduction in attenuation factor of the vibration of the meniscus, with the result that the frequency response characteristic is not improved and tends to be saturated.

The inertance ratio will be described in more detail.

When the inertance ratio is set to be 0.5 or less, the channel resistance of the ink supply ports 71 communicated with the pressure chamber 65 is increased and hence the movement of the meniscus 72 produced after the ejection of an ink drop is easily attenuated. At the same time, also the effect of the inertia flow is reduced and hence the influence of the inertia flow exerted in the movement toward the nozzle opening is reduced so that the moving speed of the meniscus is lowered.

As a result, the time period when the meniscus 72 is returned to the position where an ink drop can be ejected, or the neutral position is prolonged and the frequency response characteristic is lowered. At the same time, the kinetic energy is reduced by the amount corresponding to the reduction of the influence of the inertia flow so that the volume and flying speed of the ejected ink drop are reduced.

By contrast, when the inertance ratio is set to be 0.7 or larger, the channel resistance of the ink supply ports 71 communicated with the pressure chamber 65 is reduced and hence the returning speed of the meniscus is increased. However, the inertia flow exceeds the neutral position of the nozzle meniscus or overshoots so that the vibration of the meniscus oscillates. As described above, the time period required for stabilizing the meniscus is prolonged by the amount corresponding to the reduction in attenuation factor of the vibration of the meniscus, with the result that the frequency response characteristic is saturated.

Although the effect of the inertia flow is increased and the returning speed of the meniscus is increased, the momentum is excessive so that the meniscus 72 is projected from the nozzle opening 64. Consequently, the vicinity of the nozzle opening of the nozzle plate 63 is wetted by ink. The reduction in attenuation factor of the meniscus 72 causes vibration due to the movement of the carriage to easily affect the meniscus 72 so as to make the position of the meniscus 72 unstable. Finally, these phenomena impair the printing quality.

By contrast, when the inertance ratio Mn/(Mn+Ms') is set to be in the range of 0.5 to 0.7, the waiting period from the completion of the contraction of the piezoelectric vibrator 51 to the start of the expansion of the piezoelectric vibrator 51, i.e., the time period required for the meniscus 72 which has been pulled in, to be returned to the neutral position of the nozzle opening is approximately equal to the reciprocal (1/f) of the Helmholtz's resonance frequency f. When the meniscus 72 is returned to the neutral position for the time period of 1/f, the vibration due to the subsequent expansion of the piezoelectric vibrator 51 is superposed so that the energy exerted on the meniscus 72 is increased. As a result, the volume and ejection speed of an ink drop are increased and the ink severance is satisfactorily conducted, thereby forming the ink drop into a spherical shape.

Therefore, it is preferable as described above to select the inertance ratio to be 0.5 or larger and more preferably in the range of 0.5 to 0.7 and set the Helmholtz's resonance frequency to be 50 kHz or higher so that the inertia flow acts on the meniscus more effectively, whereby an ink drop is ejected at the timing when the meniscus 72 is at a position of the nozzle opening 64 which is as outward as possible.

In the embodiment, when the Helmholtz's resonance frequency of the pressure chamber 65 is set to be 100 kHz and the natural frequency of the piezoelectric vibrator 51 to be 100 kHz, the period of ejecting ink drops, i.e., the driving frequency of the ink jet recording head can be set to be 35 kHz at the maximum.

In the embodiment described above, the contraction time period of the piezoelectric vibrator for sucking ink into the pressure chamber, and the expansion time period of the piezoelectric vibrator for ejecting an ink drop are made equal to the period of natural vibration of the piezoelectric vibrator. In the case where the length of the piezoelectric vibrator is small so that the period of natural vibration is very short, the time periods required for expansion and contraction of the piezoelectric vibrator are set to be longer than two times the period of natural vibration of the piezoelectric vibrator and equal to the reciprocal (1/f) of the Helmholtz's resonance frequency f. This enables the conservation of energy in the piezoelectric vibrator due to resonance to be avoided more positively. Also when a record head is configured by a number of piezoelectric vibrators, variations in the driving energies of the piezoelectric vibrators which may be caused by variations in the natural frequency periods of the piezoelectric vibrators can be eliminated, thereby stabilizing the printing quality.

As described above, according to the invention, the ink jet recording head is used which comprises: a pressure chamber which is communicated with a nozzle opening of a nozzle plate and with a reservoir through an ink supply port; and a piezoelectric vibrator for, in response to a driving signal, producing volume displacement in the pressure chamber, the inertance Mn of the nozzle opening and the inertance Ms of the ink supply port having the relationship of $0.5<Mn/(Mn+Ms)$. Therefore, the meniscus is rapidly returned to the nozzle opening by an inertial energy which is due to the ink suction to the pressure chamber, so that the ink ejection is conducted in the vicinity of the outside of the nozzle opening, thereby enabling an ink drop which is substantially spherical to be ejected.

When the contraction time period of a piezoelectric vibrator for sucking ink into the pressure chamber, and an expansion time period of the piezoelectric vibrator for ejecting an ink drop from the nozzle opening are set to be 1/f (where f is the Helmholtz's resonance frequency), the residual vibration of the meniscus is reduced so that a dot which is substantially circular is formed while improving the printing speed, thereby enhancing the printing quality.

What is claimed is:

1. An ink jet recording head comprising:

a pressure chamber communicated with a nozzle opening of a nozzle plate and with a reservoir through an ink supply port; and displacement producing means for, in response to a driving signal, producing volume displacement in said pressure chamber, an inertance Mn of said nozzle opening and an inertance Ms of said ink supply port having the following relationship:

$$0.5<Mn/(Mn+Ms).$$

2. An ink jet recording head according to claim 1, wherein said displacement producing means has a longitudinal vibration mode, and, when said displacement producing means contracts, ink is sucked from said reservoir into said pressure chamber and, when said displacement producing means extends, an ink drop is ejected from said nozzle opening.

3. An ink jet recording head according to claim 1, wherein a natural frequency of said displacement producing means is equal to the Helmholtz's resonance frequency of said pressure chamber.

4. An ink jet recording head according to claim 1, wherein a natural frequency of said displacement producing means is higher than two times the Helmholtz's resonance frequency of said pressure chamber.

5. An ink jet recording head according to claim 1, wherein a contraction time period of said displacement producing means for sucking ink into said pressure chamber, and an expansion time period of said displacement producing means for ejecting an ink drop from said nozzle opening are set to be 1/f where f is the Helmholtz's resonance frequency of said pressure chamber.

6. An ink jet recording head according to claim 1, wherein a contraction time period of said displacement producing means for sucking ink into said pressure chamber, and an expansion time period of said displacement producing means for ejecting an ink drop from said nozzle opening are set to be larger than two times a period of natural vibration of said displacement producing means and equal to 1/f where f is the Helmholtz's resonance frequency of said pressure chamber.

7. An ink jet recording head according to claim 1, wherein the inertance Mn of said nozzle opening and the inertance Ms of said ink supply port are set to satisfy the following relationship:

$$0.5<Mn/(Mn+Ms)<0.7.$$

8. An ink jet recording head according to claim 1, wherein the Helmholtz's resonance frequency f of said pressure chamber is 50 kHz or higher.

9. An ink jet recording head according to claim 1, wherein the Helmholtz's resonance frequency f of said pressure chamber is 100 kHz or higher.

* * * * *